US010366668B2

(12) United States Patent
Lee et al.

(10) Patent No.: US 10,366,668 B2
(45) Date of Patent: Jul. 30, 2019

(54) DATA DRIVER AND A DISPLAY APPARATUS HAVING THE SAME

(71) Applicant: SAMSUNG DISPLAY CO., LTD., Yongin-si, Gyeonggi-do (KR)

(72) Inventors: Dongwook Lee, Asan-si (KR); Jinho Jeong, Seoul (KR); Wooil Park, Yongin-si (KR); Gyuhun Han, Seoul (KR); Seonghyun Go, Yongin-si (KR)

(73) Assignee: SAMSUNG DISPLAY CO., LTD., Suwon-si, Gyeonggi-Do (KR)

( * ) Notice: Subject to any disclaimer, the term of this patent is extended or adjusted under 35 U.S.C. 154(b) by 43 days.

(21) Appl. No.: 15/434,245

(22) Filed: Feb. 16, 2017

(65) Prior Publication Data

US 2017/0236485 A1 Aug. 17, 2017

(30) Foreign Application Priority Data

Feb. 17, 2016 (KR) ..... 10-2016-0018365

(51) Int. Cl.
*G09G 5/00* (2006.01)
*G09G 3/36* (2006.01)

(52) U.S. Cl.
CPC ..... *G09G 3/3688* (2013.01); *G09G 3/3696* (2013.01); *G09G 2300/0413* (2013.01); *G09G 2310/027* (2013.01); *G09G 2310/0291* (2013.01); *G09G 2330/08* (2013.01)

(58) Field of Classification Search
CPC ..... G09G 3/3688; G09G 3/3696; G09G 2330/08; G09G 2310/0291; G09G 2300/0413; G09G 2310/027; G09G 2320/0209
See application file for complete search history.

(56) References Cited

U.S. PATENT DOCUMENTS

| | | | | |
|---|---|---|---|---|
| 8,537,083 | B2 | 9/2013 | Nakatsuka | |
| 2009/0135124 | A1* | 5/2009 | Nakatsuka | G09G 3/3655 345/94 |
| 2010/0134470 | A1* | 6/2010 | Bu | G09G 3/3688 345/212 |
| 2010/0201669 | A1* | 8/2010 | Kim | G09G 3/3648 345/211 |
| 2014/0168560 | A1 | 6/2014 | Yamakawa | |

FOREIGN PATENT DOCUMENTS

| | | |
|---|---|---|
| KR | 1020050019172 | 3/2005 |
| KR | 1020100090870 | 8/2010 |
| KR | 1020110067819 | 6/2011 |
| KR | 1020150033156 | 4/2015 |

* cited by examiner

*Primary Examiner* — Adam R. Giesy
(74) *Attorney, Agent, or Firm* — F. Chau & Associates, LLC

(57) ABSTRACT

A data driver which drives a display panel including a data line, a gate line and a common voltage line. The data driver includes a digital-to-analog converter configured to convert a data signal to a data voltage and an output buffer configured to amplify the data voltage. The output buffer includes an output channel through which an amplified data voltage is output to the data line and a dummy channel through which a feedback voltage corresponding to a common voltage from the common voltage line is received.

19 Claims, 5 Drawing Sheets

DATA DRIVER AND A DISPLAY APPARATUS HAVING THE SAME

CROSS-REFERENCE TO RELATED APPLICATION

This application claims priority under 35 U.S.C. § 119 to Korean Patent Application No. 10-2016-0018365 filed on Feb. 17, 2016, the disclosure of which is incorporated by reference herein in its entirety.

Technical Field

Exemplary embodiments of the inventive concept relate to a data driver and a display apparatus having the data driver.

Description of the Related Art

In general, a liquid crystal display (LCD) apparatus is relatively thin, light weight and low power consuming. Thus, the LCD apparatus is widely used in monitors, laptop computers, cellular phones, etc. The LCD apparatus includes an LCD panel for displaying images, a backlight assembly for providing light to the LCD panel and a driving circuit for driving the LCD panel.

The LCD panel includes an array substrate, an opposing substrate and a liquid crystal layer disposed between the array substrate and the opposing substrate. The array substrate has a gate line, a data line, a thin film transistor and a pixel electrode, and the opposing substrate has a common electrode. A pixel of the LCD panel includes a liquid crystal capacitor and a storage capacitor. The liquid crystal capacitor includes a pixel electrode, a liquid crystal layer and a common electrode. The storage capacitor includes the pixel electrode and a storage electrode overlapping the pixel electrode. The liquid crystal capacitor charges a data voltage to display a grayscale. The storage capacitor maintains the data voltage charged in the liquid crystal capacitor during a frame period.

The storage electrode receives a common voltage. The common voltage includes a ripple signal caused by a pattern image displayed on the LCD panel and physical characteristics of the LCD panel. The ripple signal may cause crosstalk between pattern images displayed on the LCD panel, thereby decreasing a display quality of the LCD panel.

In general, a data driver for outputting a data voltage to a data line and a gate driver for outputting a gate signal to a gate line are disposed in a peripheral area of the LCD panel. The data driver may include a plurality of output channels connected to the data lines and a plurality of dummy channels not connected to the data lines. For example, in the LCD panel of the Full-HD resolution (e.g., 1920×1080), five data drivers are used and each of the data drivers has 1,284 output channels. 1,158 output channels of the 1,284 output channels may be enable channels and the remaining 126 output channels of the 1,284 output channels may be disable channels. Thus, each of the data drivers may include 126 dummy channels which are not connected to the data lines.

SUMMARY

According to an exemplary embodiment of the inventive concept, there is provided a data driver which drives a display panel comprising a data line, a gate line and a common voltage line. The data driver includes a digital-to-analog converter configured to convert a data signal to a data voltage and an output buffer configured to amplify the data voltage, wherein the output buffer comprises an output channel through which an amplified data voltage is output to the data line and a dummy channel through which a feedback voltage corresponding to a common voltage from the common voltage line is received.

In an exemplary embodiment of the inventive concept, the output buffer may include an amplifier configured to amplify the data voltage, and a switching element configured to selectively connect an output terminal of the amplifier to the dummy channel and a feedback line which outputs the feedback voltage.

In an exemplary embodiment of the inventive concept, the switching element may include a first switch which connects or disconnects the output terminal of the amplifier and the dummy channel, and a second switch which connects or disconnects the dummy channel and the feedback line.

In an exemplary embodiment of the inventive concept, the dummy channel may be connected to the common voltage line when the first switch is turned off and the second switch is turned on.

In an exemplary embodiment of the inventive concept, the dummy channel may be connected to the data line when the first switch is turned on and the second switch is turned off.

According to an exemplary embodiment of the inventive concept, there is provided a display apparatus. The display apparatus includes a display panel comprising a data line, a gate line and a common voltage line, a data driver comprising an output channel which is connected to the data line and a dummy channel which is connected to the common voltage line, a gate driver configured to output a gate signal to the gate line, and a driver circuit configured to receive a feedback voltage from the dummy channel of the data driver, to compensate a common voltage using the feedback voltage and to provide the common voltage line with compensated common voltage.

In an exemplary embodiment of the inventive concept, the common voltage line may be parallel to the data line.

In an exemplary embodiment of the inventive concept, the display panel may include a display area in which a plurality of pixels is disposed and a plurality of peripheral areas around the display area, and the data driver may be disposed in a first peripheral area of the plurality of peripheral areas and the gate driver may be disposed in a second peripheral area of the plurality of peripheral areas.

In an exemplary embodiment of the inventive concept, the display apparatus may further include a first voltage line disposed in the second peripheral area and a first area of a third peripheral area opposite to the first peripheral area, wherein a plurality of the common voltage lines are provided in the display panel, and wherein the first voltage line is configured to transfer the common voltage to the common voltage line which is disposed in a first area of the display area. The display apparatus may further include a second voltage line disposed in a fourth peripheral area opposite to the second peripheral area and a second area of the third peripheral area, and wherein the second voltage line is configured to transfer the common voltage to the common voltage line which is disposed in a second area of the display area.

In an exemplary embodiment of the inventive concept, the common voltage line which is arranged in the first area of the display area may be connected to the first voltage line which is disposed in the first area of the third peripheral area, and the common voltage line which is arranged in the second area of the display area may be connected to the second voltage line which is disposed in the second area of the third peripheral area.

In an exemplary embodiment of the inventive concept, the data driver may include a digital-to-analog converter configured to convert a data signal to a data voltage, and an output buffer configured to amplify the data voltage, wherein the output buffer comprises the output channel and the dummy channel.

In an exemplary embodiment of the inventive concept, the output buffer may include an amplifier configured to amplify the data voltage and a switching element configured to selectively connect an output terminal of the amplifier to the dummy channel and a feedback line which outputs the feedback voltage.

In an exemplary embodiment of the inventive concept, the switching element may include a first switch which connects or disconnects the output terminal of the amplifier and the dummy channel, and a second switch which connects or disconnects the dummy channel and the feedback line.

In an exemplary embodiment of the inventive concept, the dummy channel may be connected to the common voltage line when the first switch is turned off and the second switch is turned on.

In an exemplary embodiment of the inventive concept, the dummy channel may be connected to the data line when the first switch is turned on and the second switch is turned off.

In an exemplary embodiment of the inventive concept, the driver circuit may include a voltage generator configured to generate the common voltage, and a voltage compensator configured to generate a ripple compensation voltage using a reference common voltage and the feedback voltage, wherein the voltage generator may be configured to generate a compensated common voltage by using the ripple compensation voltage.

According to an exemplary embodiment of the inventive concept, there is provided a display apparatus that includes a plurality of data lines, a plurality of gate lines, a plurality of common voltage lines and a plurality of voltage lines; a display panel including a display area and a peripheral area disposed adjacent to the display area; a data driver including a dummy channel; and a driver circuit connected to the data driver, wherein the data driver is configured to provide a feedback voltage of a common voltage through the dummy channel without passing through the peripheral area.

In an exemplary embodiment of the inventive concept, the data driver may include a switching circuit configured to connect the dummy channel to a feedback line and one of the common voltage lines.

In an exemplary embodiment of the inventive concept, the data driver may include an output channel and the switching circuit may be configured to connect the output channel to one of the data lines when the dummy channel is disconnected from the common voltage line.

In an exemplary embodiment of the inventive concept, the common voltage lines may be disposed in the display area and the voltage lines may be disposed in the peripheral area.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION OF THE EMBODIMENTS

Hereinafter, exemplary embodiments of the inventive concept will be explained in detail with reference to the accompanying drawings.

Figure 1:
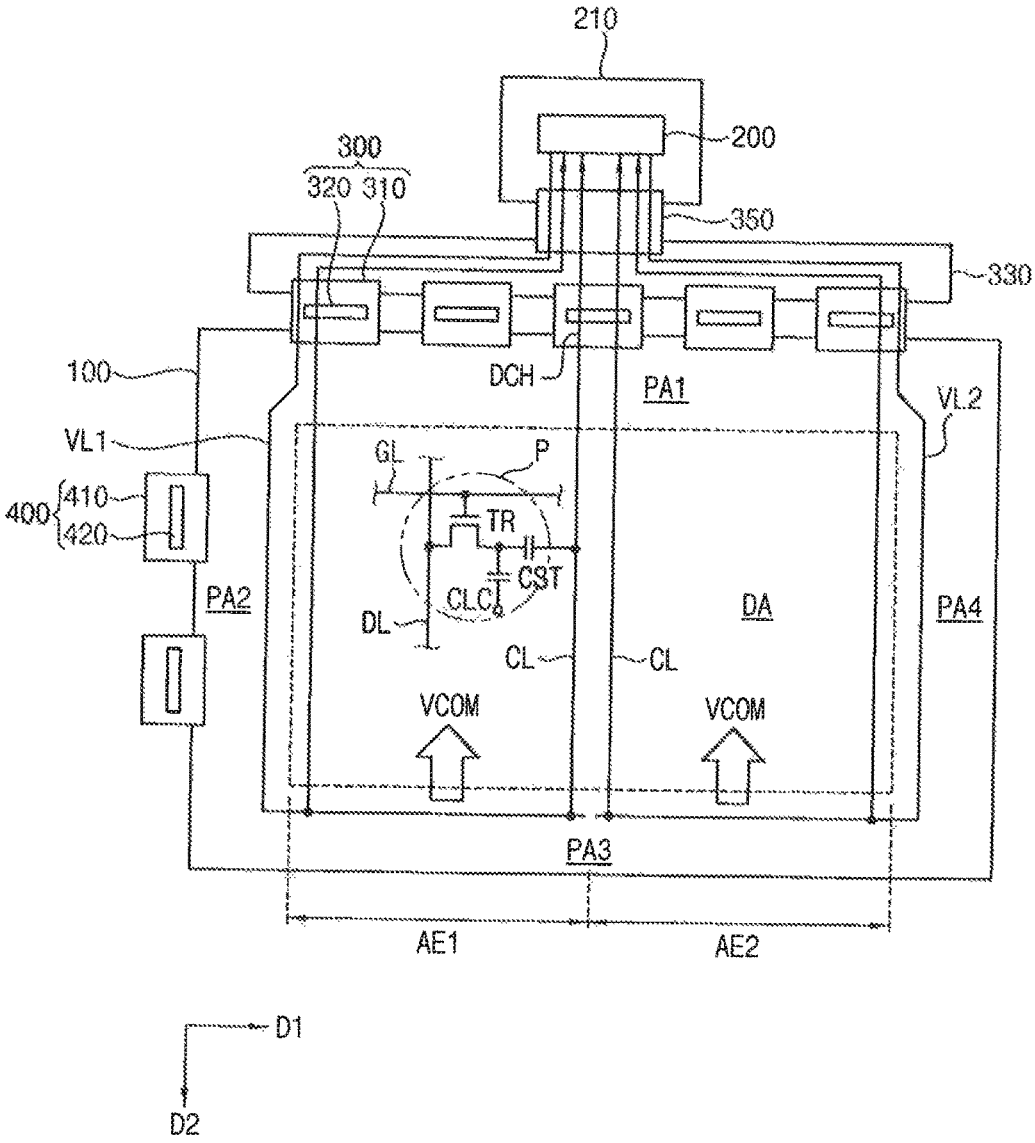
FIG. 1 is a diagram illustrating a display apparatus according to an exemplary embodiment of the inventive concept.

FIG. 1 is a diagram illustrating a display apparatus according to an exemplary embodiment of the inventive concept.

Referring to FIG. 1, the display apparatus may include a display panel 100, a main driver circuit 200, a data driver circuit 300 and a gate driver circuit 400.

The display panel 100 may include a display area DA and a plurality of peripheral areas PA1, PA2, PA3 and PA4 around the display area DA.

A plurality of data lines DL, a plurality of gate lines GL, a plurality of common lines CL and a plurality of pixels P may be disposed in the display area DA.

The gate lines GL extend in a first direction D1 and are arranged in a second direction D2 crossing the first direction D1. The common lines CL may extend in the second direction D2 and be arranged in the first direction D1. The data lines DL extend in the second direction D2 and are arranged in the first direction D1. The pixels P may be arranged in a matrix which includes a plurality of pixel columns arranged in the first direction D1 and a plurality of pixel rows arranged in the second direction D2. Each of the pixels P may include a thin film transistor TR, a liquid crystal capacitor CLC and a storage capacitor CST. The thin film transistor TR may be connected to a data line DL and a gate line GL, the liquid crystal capacitor CLC may be connected to the thin film transistor TR and the storage capacitor CST, and the storage capacitor CST may connected to the common line CL that transfers a common voltage VCOM.

A first peripheral area PA1 may be adjacent to an end portion of the data line DL and the data driver circuit 300 may be disposed in the first peripheral area PA1. For example, the first peripheral area PA1 may be near a first end portion of a data line DL.

A second peripheral area PA2 may be adjacent to an end portion of the gate line GL and the gate driver circuit 400 may be disposed in the second peripheral area PA2. For example, the second peripheral area PA2 may be near a first end portion of the gate line GL. A first voltage line VL1 may be disposed in the second peripheral area PA2 and configured to transfer a common voltage VCOM to the common lines CL which are arranged in a first area AE1 of the display area DA. The first voltage line VL1 may pass through the second peripheral area PA2 and extend to a first area of a third peripheral area PA3 opposite to the first peripheral area PA1. The first voltage line VL1 may be connected to the common lines CL, which are arranged in the first area AE1 of the display area DA, in the third peripheral area PA3.

A second voltage line VL2 may be disposed in the fourth peripheral area PA4 and configured to transfer a common voltage VCOM to the common lines CL which are arranged in a second area AE2 of the display area DA. The second voltage line VL2 may pass through the fourth peripheral area PA4 and extend to a second area of the third peripheral area PA3 opposite to the first peripheral area PA1. The second voltage line VL2 may be connected to the common lines CL, which are arranged in the second area AE2 of the display area DA, in the third peripheral area PA3.

The main driver circuit 200 may be disposed on a main printed circuit board 210. The main driver circuit 200 is configured to control the data driver circuit 300, the gate driver circuit 400 and the display panel 100.

For example, the main driver circuit 200 is configured to generate a data control signal and a data driving voltage for driving the data driver circuit 300. The data control signal may include a horizontal synchronization signal, a vertical synchronization signal, a load signal, etc. The main driver circuit 200 is configured to receive red R, green G and blue B data, and to correct the R, G and B data through correction algorithms for increasing a response time and compensating a white. The main driver circuit 200 is configured to provide the data driver circuit 300 with the corrected R, G and B data.

The main driver circuit 200 is configured to output a gate control signal and a gate driving voltage for driving the gate driver circuit 400. The gate control signal may include a vertical start signal and at least one clock signal.

The main driver circuit 200 is configured to receive a feedback voltage corresponding to a common voltage VCOM from the common lines CL and to generate a compensated common voltage VCOM_C which eliminates a ripple based on the feedback voltage.

The data driver circuit 300 may include a data flexible circuit board 310 and a data driver 320 mounted on the data flexible circuit board 310. The data driver circuit 300 may be connected to the main driver circuit 200 through a source printed circuit board 330 and a flexible circuit board 350.

The data driver 320 is configured to convert a data signal to a data voltage in response to or based on a data control signal received from the main driver circuit 200, and to output the data voltage to the data line DL.

The data driver 320 may include an output channel connected to the data line DL and a dummy channel connected to the common line CL. The dummy channel is configured to receive the feedback voltage corresponding to the common voltage VCOM from the common line CL. The feedback voltage received from the dummy channel may be transferred to the main driver circuit 200 through the source printed circuit board 330 and the flexible circuit board 350.

The gate driver circuit 400 may include a gate flexible circuit board 410 and a gate driver 420 mounted on the gate flexible circuit board 410. The gate driver 420 is configured to receive a gate control signal from the main driver circuit 200 through the data flexible circuit board 310. The gate driver 420 is configured to generate a gate signal in response to or based on the gate control signal, and to output the gate signal to the gate line GL.

The gate driver 420 may be integrated in a peripheral area PA (e.g., at least one of PA1, PA2, PA3 and PA4) of the display panel 100. For example, the gate driver 420 may be formed via substantially the same process as that of forming the thin film transistor TR in the display area DA.

Figure 2:
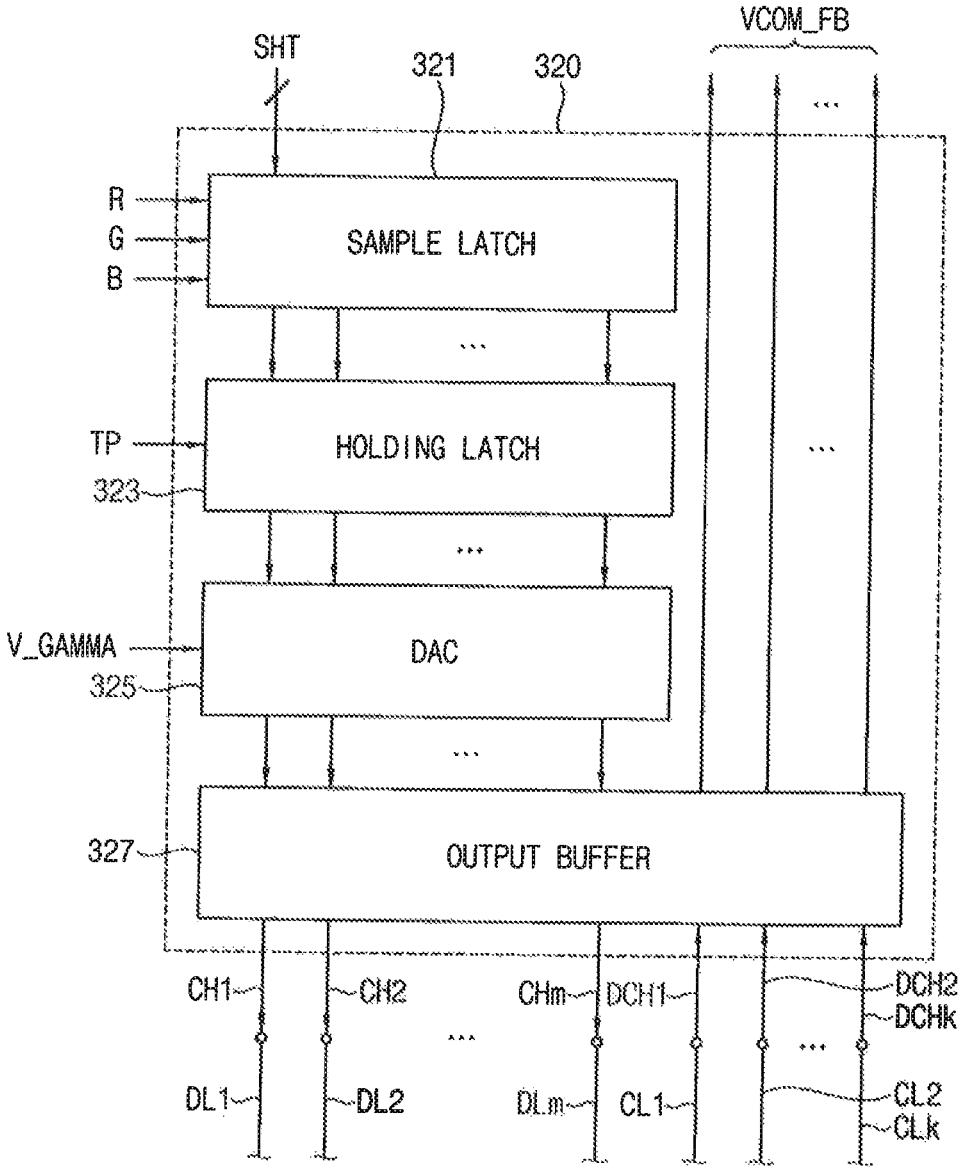
FIG. 2 is a block diagram illustrating a data driver according to an exemplary embodiment of the inventive concept.

FIG. 2 is a block diagram illustrating a data driver according to an exemplary embodiment of the inventive concept.

Referring to FIGS. 1 and 2, the data driver 320 may include a sample latch 321, a holding latch 323, a digital-to-analog converter (DAC) 325 and an output buffer 327.

The sample latch 321 is configured to arrange R, G and B data received from the main driver circuit 200 by a horizontal line unit in synchronization with a shift signal SHT.

The holding latch 323 is configured to store the R, G and B data received from the sample latch 321 by the horizontal line unit. The holding latch 323 is configured to output the R, G and B data of the horizontal line unit in response to a load signal TP received from the main driver circuit 200.

The digital-to-analog converter 325 is configured to convert the R, G and B data received from the holding latch 323 to R, G and B data voltages using a gamma voltage V_GAMMA.

The output buffer 327 is configured to amplify the R, G and B data voltages and to output amplified R, G and B data voltages.

The output buffer 327 may include a plurality of output channels CH1 . . . CHm and a plurality of dummy channels DCH1 . . . DCHk. The plurality of output channels CH1 . . . CHm is connected to the plurality of data lines DL . . . DLm, respectively, and is configured to output the amplified R, G and B data voltages to the plurality of data lines DL . . . DLm, respectively.

The plurality of dummy channels DCH1 . . . DCHk is connected to a plurality of common lines CL1 . . . CLk, respectively. The plurality of dummy channels DCH1 . . . DCHk is configured to receive a feedback voltage VCOM_FB corresponding to the common voltage applied to the common lines CL1 . . . CLk through the plurality of common lines CL1 . . . CLk.

The feedback voltage VCOM_FB received from the plurality of dummy channels DCH1 . . . DCHk is applied to the main driver circuit 200. The main driver circuit 200 is configured to compensate a ripple of the feedback voltage VCOM_FB and to generate a compensated common voltage.

Figure 3:
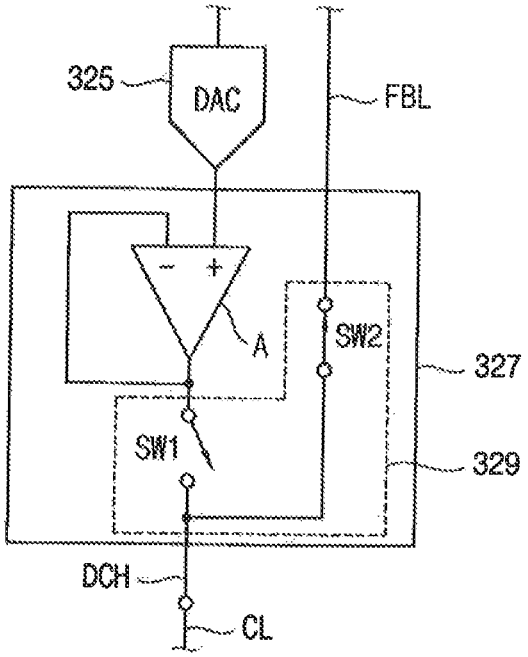
FIG. 3 is a diagram illustrating an output buffer connected to a feedback line according to an exemplary embodiment of the inventive concept.
Figure 4:
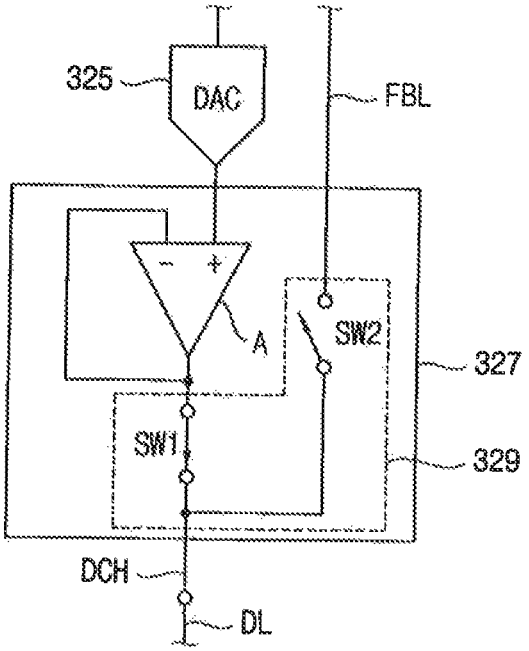
FIG. 4 is a diagram illustrating an output buffer connected to a data line according to an exemplary embodiment of the inventive concept.

FIG. 3 is a diagram illustrating an output buffer connected to a feedback line according to an exemplary embodiment of the inventive concept. FIG. 4 is a diagram illustrating an output buffer connected to a data line according to an exemplary embodiment of the present inventive concept.

Referring to FIGS. 2 and 3, the output buffer 327 may include an amplifier A and a switching element 329. The amplifier A is configured to amplify the data voltage received from the digital-to-analog converter 325.

The switching element 329 is configured to selectively connect an output terminal of the amplifier A to the dummy channel DCH and a feedback line FBL for transferring the feedback voltage.

The switching element 329 may include a single switch. Alternatively, as shown in FIG. 3, the switching element 329 may include a first switch SW1 and a second switch SW2.

The first switch SW1 is configured to connect or disconnect the output terminal of the amplifier A and the dummy channel DCH of the data driver 320. The dummy channel DCH is connected to an end portion of the common line CL. For example, the dummy channel DCH is connected to a first end portion of the common line CL.

The second switch SW2 is configured to connect or disconnect the dummy channel DCH and the feedback line FBL. The feedback line FBL is connected to the main driver circuit 200 through a plurality of signal lines formed on the source printed circuit board 330 and the flexible circuit board 350.

When the first switch SW1 is turned off and the second switch SW2 is turned on, the dummy channel DCH is disconnected from the output terminal of the amplifier A and the dummy channel DCH is connected to the feedback line FBL. Thus, the dummy channel DCH may receive the feedback voltage from the common line CL and the feedback voltage may be transferred to the main driver circuit 200 through the feedback line FBL.

However, the dummy channel DCH may be used as the output channel for outputting the data voltage. Referring to FIG. 4, when the first switch SW1 is turned on and the second switch SW2 is turned off, the dummy channel DCH is connected to the output terminal of the amplifier A and the dummy channel DCH is disconnected from the feedback line FBL. Thus, the dummy channel DCH may transfer the data voltage amplified from the amplifier A to the data line DL.

According to an exemplary embodiment, the dummy channel which is not used for outputting the data voltage in the data driver may be used as a feedback channel for compensating the ripple of the common voltage. As described above, the dummy channel of the data driver may be used as the feedback channel, and thus, a feedback path of the common voltage may be decreased, and thus, a ripple distortion of the common voltage may be decreased.

Figure 5:
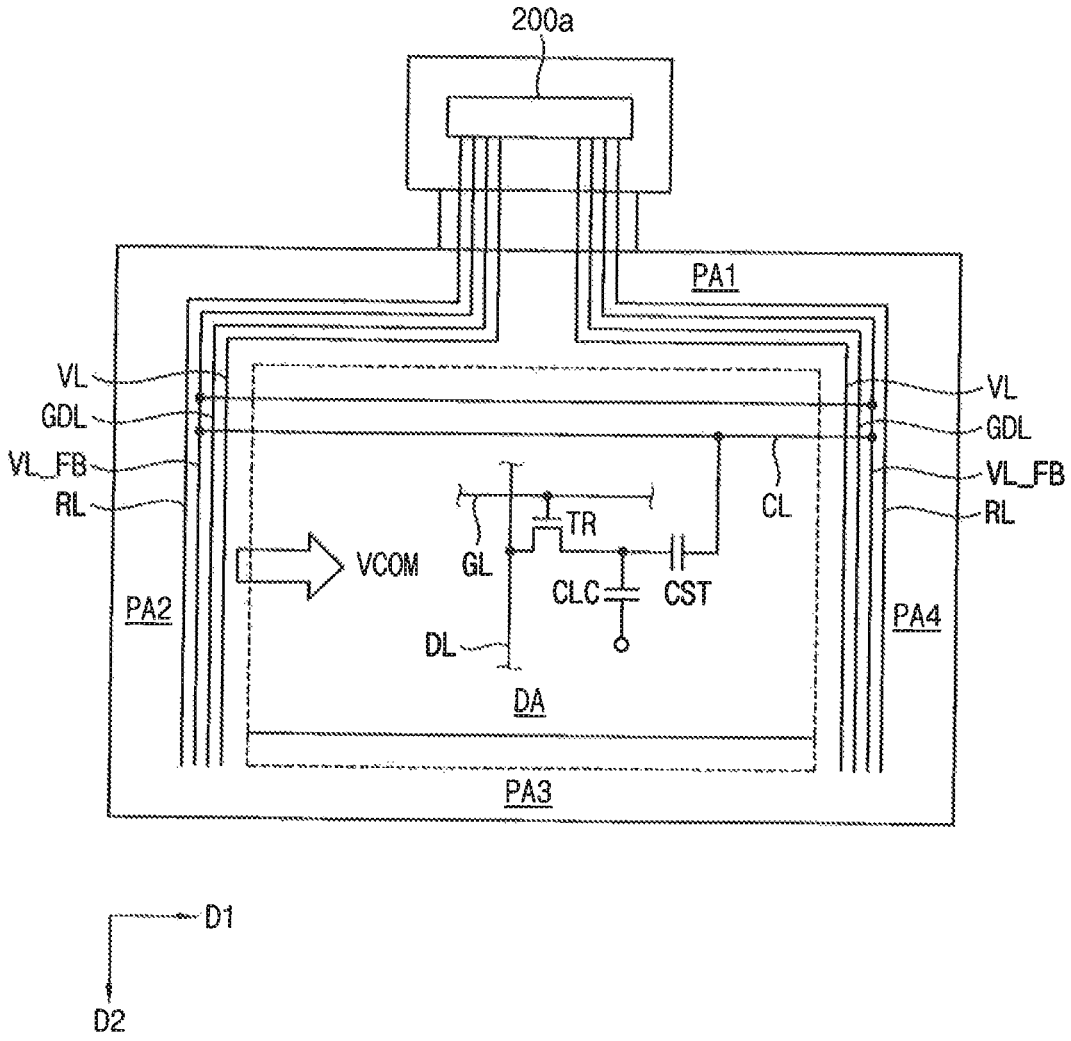
FIG. 5 is a diagram illustrating a display apparatus a according to a comparative example embodiment.

FIG. 5 is a diagram illustrating a display apparatus a according to a comparative example embodiment.

Referring to FIG. 5, according to the comparative example embodiment, a voltage line VL for transferring a common voltage, a gate driving line GDL for transferring a gate driving signal to a gate driver, a feedback voltage line VL_FB for transferring a feedback voltage of the common voltage and a repair line RL for repairing a defect line may be disposed in first, second and fourth peripheral areas PA1, PA2 and PA4 of a display panel.

According to the comparative example embodiment, a main driver circuit 200*a* is configured to generate the common voltage and to transfer the common voltage to a common line CL of a display area DA through the voltage line VL. The common line CL extends in a first direction D1 and is arranged in a second direction D2 crossing the first direction D1. The common line CL is parallel to a gate line GL. The feedback voltage line VL_FB is configured to transfer a feedback voltage corresponding to the common voltage received from the common line CL to the main driver circuit 200*a*. The main driver circuit 200*a* is configured to compensate a ripple in the feedback voltage and to generate compensated common voltage.

As shown in FIG. 5, the feedback voltage line VL_FB passes through the first, second and fourth peripheral areas PA1, PA2 and PA4 and is connected to the main driver circuit 200*a*. Thus, a ripple in the feedback voltage may be distorted by load of the display panel. Therefore, the main driver circuit 200*a* is configured to compensate the common voltage based on the distorted ripple, and thus, an accuracy of the compensation may decrease.

According to an exemplary embodiment of the inventive concept, the feedback voltage of the common voltage may be transferred through the dummy channel of the data driver without passing the peripheral area of the display panel, and thus, the accuracy of the compensation may increase by decreasing the distortion of the ripple.

In addition, according to an exemplary embodiment of the inventive concept, the feedback voltage line VL_FB, which is disposed in the peripheral area in the comparative example embodiment, may be omitted and thus the peripheral area of the display panel may decrease. For example, a black matrix (BM) area of the display apparatus may decrease.

Figure 6:
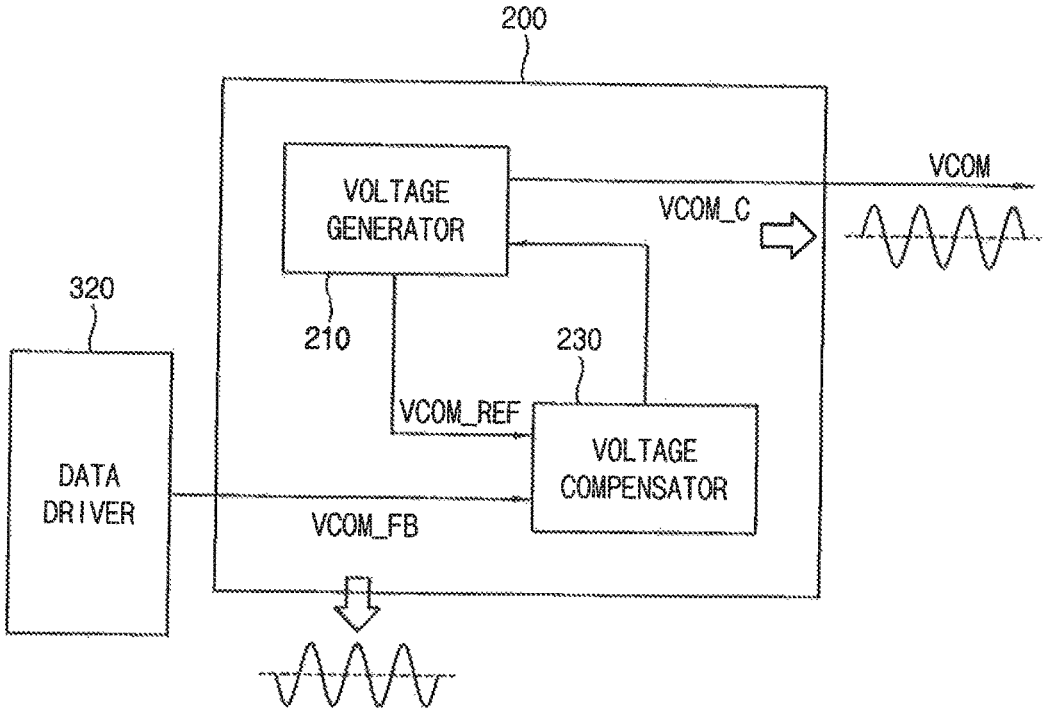
FIG. 6 is a block diagram illustrating a main driver circuit according to an exemplary embodiment of the inventive concept.

FIG. 6 is a block diagram illustrating a main driver circuit according to an exemplary embodiment of the inventive concept.

Referring to FIGS. 1 and 6, the main driver circuit 200 may include a voltage generator 210 and a voltage compensator 230.

The voltage generator 210 is configured to generate a reference common voltage VCOM_REF using an input voltage, to compensate the ripple of the common voltage using a ripple compensation voltage VCOM_C received from the voltage compensator 230 and to output the compensated common voltage VCOM.

The voltage compensator 230 is configured to generate the ripple compensation voltage VCOM_C using the reference common voltage VCOM_REF received from the voltage generator 210 and a feedback voltage VCOM_FB received from the data driver 320. The ripple compensation voltage VCOM_C has a phase opposite to that of the feedback voltage VCOM_FB. The voltage compensator 230 is configured to provide the voltage generator 210 with the ripple compensation voltage VCOM_C.

The voltage generator 210 is configured to generate the compensated common voltage VCOM which includes the ripple compensation voltage VCOM_C, and to output the compensated common voltage VCOM.

According to an exemplary embodiment of the inventive concept, the feedback voltage of the common voltage may be transferred through the dummy channel of the data driver without passing through the peripheral area of the display panel, and thus, the accuracy of the compensation may increase by decreasing the distortion of the ripple. In addition, according to an exemplary embodiment of the inventive concept, the feedback voltage line disposed in the peripheral area may be omitted and thus a black matrix (BM) area of the display apparatus may decrease.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A data driver which drives a display panel comprising a data line, a gate line and a common voltage line, the data driver comprising:

a digital-to-analog converter configured to convert a data signal to a data voltage;

an output buffer configured to amplify the data voltage, wherein the output buffer comprises an output channel through which an amplified data voltage is output to the data line and a dummy channel through which a feedback voltage corresponding to a common voltage from the common voltage line is received;

a feedback line connected to the dummy channel, wherein the output buffer further comprises a switching element configured to connect the dummy channel to the feedback line.

2. The data driver of claim 1, wherein the output buffer comprises an amplifier configured to amplify the data voltage, and wherein the switching element is further configured to selectively connect an output terminal of the amplifier to the dummy channel and the feedback line which outputs the feedback voltage.

3. The data driver of claim 2, wherein the switching element comprises a first switch which connects or disconnects the output terminal of the amplifier and the dummy channel, and a second switch which connects or disconnects the dummy channel and the feedback line.

4. The data driver of claim 3, wherein the dummy channel is connected to the common voltage line when the first switch is turned off and the second switch is turned on.

5. The data driver of claim 3, wherein the dummy channel is connected to the data line when the first switch is turned on and the second switch is turned off.

6. A display apparatus, comprising:

a display panel comprising a data line, a gate line and a common voltage line;

a data driver comprising an output channel which is connected to the data line, a dummy channel which is connected to the common voltage line and a feedback line connected to the dummy channel, wherein the data driver further comprises a switching element to selectively connect the feedback line to the dummy channel;

a gate driver configured to output a gate signal to the gate line; and a driver circuit configured to receive a feedback voltage from the feedback line of the data driver, to compensate a common voltage using the feedback voltage and to provide the common voltage line with compensated common voltage.

7. The display apparatus of claim 6, wherein the common voltage line is parallel to the data line.

8. The display apparatus of claim 6, wherein the display panel comprises a display area in which a plurality of pixels is disposed and a plurality of peripheral areas around the display area, and the data driver is disposed in a first peripheral area of the plurality of peripheral areas and the gate driver is disposed in a second peripheral area of the plurality of peripheral areas.

9. The display, apparatus of claim 8, further comprising:

a first voltage line disposed in the second peripheral area and a first area of a third peripheral area opposite to the first peripheral area, wherein a plurality of the common voltage lines are provided in the display panel, and wherein the first voltage line is configured to transfer the common voltage to the common voltage line which is disposed in a first area of the display area; and a second voltage line disposed in a fourth peripheral area opposite to the second peripheral area and a second area of the third peripheral area, wherein the second voltage line is configured to transfer the common voltage to the common voltage line which is disposed in a second area of the display area.

10. The display apparatus of claim 9, wherein the common voltage line which is arranged in the first area of the display area is connected to the first voltage line which is disposed in the first area of the third peripheral area, and the common voltage line which is arranged in the second area of the display area is connected to the second voltage line which is disposed in the second area of the third peripheral area.

11. The display apparatus of claim 6, wherein the data driver comprises:

a digital-to-analog converter configured to convert a data signal to a data voltage; and an output buffer configured to amplify the data voltage, wherein the output buffer comprises the output channel and the dummy channel.

12. The display apparatus of claim 11, wherein the output buffer comprises:

an amplifier configured to amplify the data voltage; and the switching element configured to selectively connect an output terminal of the amplifier to the dummy channel and the feedback line which outputs the feedback voltage.

13. The display apparatus of claim 12, wherein the switching element comprises a first switch which connects or disconnects the output terminal of the amplifier and the dummy channel, and a second switch which connects or disconnects the dummy channel and the feedback line.

14. The display apparatus of claim 13, wherein the dummy channel is connected to the common voltage line when the first switch is turned off and the second switch is turned on.

15. The display apparatus of claim 13, wherein the dummy channel is connected to the data line when the first swath is turned on and the second switch is turned off.

16. The display apparatus of claim 6, wherein the driver circuit comprises:

a voltage generator configured to generate the common voltage; and a voltage compensator configured to generate a ripple compensation voltage using a reference common voltage and the feedback voltage, wherein the voltage generator is configured to generate a compensated common voltage by using the ripple compensation voltage.

17. A display apparatus, comprising:

a plurality of data lines, a plurality of gate lines, a plurality of common voltage lines and a plurality of voltage lines;

a display panel including a display area and a peripheral area disposed adjacent to the display area;

a data driver including a dummy channel and a feedback line connected to the dummy channel; and a driver circuit connected to the data driver, wherein the data driver is configured to provide a feedback voltage of a common voltage through the feedback line without passing through the peripheral area, wherein the data driver includes a switching circuit configured to connect the dummy channel to the feedback line and one of the common voltage lines.

18. The display apparatus of claim 17, wherein the data driver further includes an output channel and the switching circuit is configured to connect the output channel to one of the data lines when the dummy channel is disconnected from the common voltage line.

19. The display apparatus of claim 17, wherein the common voltage lines are disposed in the display area and the voltage lines are disposed in the peripheral area.

* * * * *